US006076575A

United States Patent [19]

Harkness

[11] Patent Number: 6,076,575

[45] Date of Patent: Jun. 20, 2000

[54] APPARATUS FOR FORMING DOVETAIL, BOX AND RELATED JOINTS

[76] Inventor: Richard C. Harkness, 4635 - 138th Ave. SE., Bellevue, Wash. 98006

[21] Appl. No.: 09/034,121

[22] Filed: Mar. 3, 1998

[51] Int. Cl.[7] ..... B27C 5/00

[52] U.S. Cl. ..... 144/144.1; 144/144.51; 144/372

[58] Field of Search ..... 144/137, 144.1, 144/144.51, 144.52, 372, 84; 33/197, 562, 567, 567.1, 571, 628, 630, 638; 409/125, 130

[56] References Cited

U.S. PATENT DOCUMENTS

| | | | |
|---|---|---|---|
| 3,800,840 | 4/1974 | McCord, Jr. | 144/87 |
| 4,168,730 | 9/1979 | Keller . | |
| 4,407,344 | 10/1983 | Dicke | 144/87 |
| 4,428,408 | 1/1984 | Grisley | 144/144.5 R |
| 4,793,604 | 12/1988 | Taylor | 269/303 |
| 4,995,435 | 2/1991 | Godfrey | 144/363 |
| 5,114,265 | 5/1992 | Grisley | 403/381 |
| 5,199,477 | 4/1993 | Keller | 194/372 |
| 5,215,296 | 6/1993 | Adams | 269/60 |
| 5,318,082 | 6/1994 | Von Hollen | 144/84 |

*Primary Examiner*—W Donald Bray

[57] ABSTRACT

A jig used to support and guide a router has a support base to which the workpiece is clamped as well as a moveable template containing guiding surfaces for a router. The template is attached to the support base via an elongated support channel. The support channel is permanently attached to the support base and captures two square nuts used to clamp the template to said channel while cutting but allowing the template to be loosened and repositioned between cuts. A bar clamped to the underside of the template is pressed against the channel to align both in parallel and, by virtue of being attached to the template via angled slots, can be used to adjust the position of guiding surfaces in the template relative to the workpiece. The template has a variety of slots and cutouts whose sides guide the router in the making of specific cuts for dovetail, box and related joints. The template is indexed from one cutting position to another by means of a ratchet or equivalent which engages the teeth of a saw tooth rack. The pitch or distance between teeth is precise and carefully chosen in regard to a variety of factors. The jig essentially cuts tails or pins one at a time. Its adjustable nature allows wide variation in joint design including the size and spacing of joint elements.

14 Claims, 5 Drawing Sheets

APPARATUS FOR FORMING DOVETAIL, BOX AND RELATED JOINTS

BACKGROUND—FIELD OF INVENTION

The invention relates to woodworking tools, and more particularly to jigs for positioning routers while cutting dovetail, box or related joints in the ends of boards.

BACKGROUND—DISCUSSION OF PRIOR ART

Dovetail, box and related joints are commonly used to construct furniture, boxes and other wooden articles. Although such joints can be hand cut with a saw and chisel it is more precise and convenient to use a router guided by a jig which positions the router accurately relative to the board.

Although many designs have been patented, none offer the combined advantages of the present invention; namely: the ability to vary tail and pin size, the ability to mix dovetail and box elements in the same joint, the ability to use different angle dovetail cutters, the ability to operate without ruled scales, the ability to accurately reproduce joints made previously, and the ability to position the jig's movable template by eye. In addition to these advantages the present invention makes extremely accurate repeatable joints, is rugged, and is inexpensive to manufacture. Details of the prior art follow.

The most common dovetail or box jig has a plurality of fingers or cutouts cut into a flat template, basically one for each dovetail or pin. A bushing on the base of the router or bearing on the cutter bit's shaft follows the pattern defined by the fingers thus making the cuts. See U.S. Pat. Nos. 3,800,840; 4,168,730; 4,407,344; and 5,199,477. Such jigs work fine but since the fingers are of fixed shape and spacing they can only make a single design, usually a row of identically sized dovetails or pins all spaced alike. However, many craftsman desire to create more distinctive joints whose dovetails and pins vary in size, shape or spacing across the length of the joint, and they want an adjustable jig so these parameters can be changed from one project to another. Several jigs have been invented with these goals in mind: e.g. Grisley (U.S. Pat. No. 4,428,408); Von Holland (U.S. Pat. No. 5,318,082); Taylor (U.S. Pat. No. 4,793,604); and Adams (U.S. Pat. No. 5,215,296). However, this prior art has disadvantages as described below.

The jig described in the Grisley patent (widely marketed as the "Leigh" jig) has a plurality of intricately shaped, movable fingers which are expensive to manufacture and are subject to accidental flexing or damage due to their thin tips. In addition, the length of the surfaces needed to hold the fingers normal to the jig's axis and the space needed for a locking screw limit the minimum spacing between tails to about one inch. This precludes the Grisley jig from making small joints with pitches less than one inch between tails or pins. Still another disadvantage of the Grisley jig is that, since the fingers can be positioned at an infinite number of places along the bar, there is no way to put them exactly where one wants or to return them to the same place once they have been moved. This means it is impossible to make a joint with exact dimensions, or a perfectly symmetrical joint, or to duplicate a joint or joint member later if the fingers have been moved meantime. Another disadvantage of the Grisley patent is the inability of the jig to cut box joints. (In practice a whole separate set of fingers can be purchased for the Leigh jig to cut box joints, but that is quite expensive.) Nor does the Grisley patent give the craftsman the option of using more than one taper of dovetail bit. (The Leigh jig will only make through dovetail joints with 8 degree dovetail bits, but 14 degree bits are also popular with craftsman and give a different look than 8 degree bits.) Finally, the Grisley patent requires the fore/aft position of the fingers to be accurately aligned with a mark on each end of the jig every time the fingers are flipped from cutting pins to cutting tails. This process is subject to error. Altogether the Grisley jig is expensive to manufacture, somewhat fragile, difficult to adjust, and limits the choice of designs available to the craftsman.

The Von Holland "Universal Jointer" jig has a template that moves, in indexed steps, relative to the board being cut, and it uses a series of holes as the means of indexing. However Von Holland's drawings show only templates with three slots, and the fixed spacing between these slots render this jig unsuitable for making tails and pins of arbitrary size or spacing. Indeed the Von Holland jig appears to be a variation on jigs having a plurality of fixed fingers, except it only has three. Thus Von Holland's indexing appears to reposition the template from one set of three cuts to the next set. Beyond being constrained in the variety of joint designs it can produce there are a number of other practical shortcomings with the Von Holland jig. These include: 1) the need to prevent any wobble whatever in the "positioner stop" which in turn necessitates a rather thick "positioner" plus the shank of the positioner stop having to fit very precisely within the indexing holes, all which drive up manufacturing cost; 2) the lack of a means to ensure the template will not skew when adjusted fore/aft for joint tightness; 3) the need to change inserts for various cuts; 4) the fact that indexing is apparently only possible "in increments of different bit diameters"; 5) the non-intuitive nature of the indexing process. Finally the sheer number of surfaces that must be machined or otherwise rendered with precision suggest this device would be expensive to manufacture.

The Godfrey jig (U.S. Pat. No. 4,995,435) is interesting because it employs a saw tooth rack that bears some similarity to a key aspect of the present invention. However, close inspection reveals that Godfrey's rack is used to help clamp the workpiece and plays no role in indexing the lateral movement of the template as it moves from one cutting position to another. There are various disadvantages of this patent including: the side by side arrangement of the two workpieces which would require a jig in excess of 48 inches wide to hold workpieces 24 inches wide (an industry norm); the large number of precision mating surfaces required; and the inability to hold to or repeat any specified pattern (since there is no absolute means of indexing).

There are several general purpose positioning devices that when used with a table mounted router can help produce dovetail joints with variable tail and pin spacings. For, example Adams (U.S. Pat. No. 5,215,296) (marketed under the name "Join Tech") describes a device which can move a piece of wood attached to it laterally by employing a lead screw. In practice this device does not move the work in discrete steps and requires the use of precision scales to indicate where the board is positioned. The whole process of joint planning and cutting is quite different from, and more complex than, the proposed invention. This device also lacks any means to hold the workpiece or to set the angle needed to cut the sides of pins. As such it is not a dovetail jig per se but rather only a lateral positioning device. Still another major disadvantage of this approach is that boards must be held normal relative to the router table and moved across that table through the protruding cutter, requiring a device with considerable strength. The Adams jig has no means to hold long boards rigidly enough for such work, and in practice is probably suitable only for constructing small boxes.

The Taylor jig (U.S. Pat. No. 4,793,604) is widely marketed under the name "Incra" jig. It is quite similar to the Adams jig in concept, geometry, common use, and also in the disadvantages cited above. The Taylor jig meshes the teeth of opposing gear racks as a means of indexing. A subtle but important consequence of this is that the two segments of rack must be moved apart to change settings and then be brought back into full engagement to prevent any further movement or play which would impair the precision of the cut. While developing the present invention this approach was seriously considered but abandoned for several reasons. First, the precision racks require either expensive tooling or expensive machining. Second, if rendered in an affordable but dimensionally unstable material like molded plastic as Incra has done, it would be hard to maintain absolute tolerances over the long (about 30 inch) rack lengths needed to cut wide boards (the Incra jig uses racks only about 5 inches long with a tooth pitch of $1/32^{nd}$ inch). Third, the need to position the two pieces of the opposing rack a precise distance apart, namely zero, at full engagement would have required expensive precision in other components of the present invention. Finally, changing settings would require moving the racks apart and bumping the teeth along. In short, the indexing approach used by Taylor works well within the context of his overall invention and its intended use which appears to be that of making small boxes. However this indexing approach would not work well within the complete jig system specified later in this application. A better way to achieve accurate indexing is needed.

SUMMARY

The present invention comprises a jig for making dovetail, box and related joints comprising:

- a support structure comprised of a support base with attached support channel and clamping bar which in combination support and hold a workpiece and a template in proper position relative to each other,
- a template which incorporates the guiding surfaces needed to direct a router in the cutting of dovetail, box and/or related joints and which in addition is designed to be repositioned a number of times in order to execute the plurality of cuts needed to define a row of tails, pins or equivalent joint elements across the end of a workpiece,
- clamps for keeping the template from moving relative to the support structure and workpiece when cuts are being made,
- repositioning members which comprise a support channel attached to the support base and a adjusting bar attached to the template which are slideable against each other and which allow the template to be repositioned from one cutting position to another in a direction coaxial to the row of joint elements while not altering any other aspect of the templates orientation to the workpiece,
- angled slots in the template through which the aforementioned bar is clamped to the template such that lateral adjustments of the bar relative the template will also translate into a fore/aft displacement between their axes that, when the bar is in contact with the support channel, provides a way to adjust the fore/aft position of the template relative to the workpiece and thus fine tune joint tightness,
- an elongated toothed rack coaxial with and fixed to the support structure with said rack having a plurality of equally and precisely spaced teeth whose surfaces function as indexing or reference points in establishing the proper lateral position of the template relative to the workpiece,
- a ratchet or equivalent indexing member attached on one end to the template the other end of said ratchet or member being designed to seat against one tooth or between two teeth on the aforementioned rack for the purpose of accurately indexing or establishing the lateral position of the template relative to the workpiece in one of a plurality of acceptable cutting positions known to be separated by some exact integral multiple of the tooth pitch.

In addition there is an embodiment which reuses the above mentioned indexing mechanism but with a different support structure and template. This embodiment is designed to cut tenon sockets or mortises across the face of a wide panel.

OBJECTS AND ADVANTAGES

The object of the present invention is to combine in one jig a number of attributes or advantages not found in any one jig known to date. It is therefore the principal object of the present invention to provide an improved device for positioning a router relative to a workpiece for the purpose of cutting dovetail, box and other similar joints.

Another object of the present invention is to provide a means to position a router template relative to a workpiece accurately to a few thousandths of an inch and make it possible to return to a former position with this same accuracy. A closely related objective is to provide a means for positioning a router template relative to a workpiece with great precision without forcing the craftsman to make analog adjustments requiring the precise alignment of hairlines with precision rules or scales.

Other objectives of the present invention are to provide a single jig which allows the craftsman to: create joints with different size and shape pins and tails, and different spaces between them all in the same joint; mix dovetail and box elements in the same joint; cut both through and halfblind dovetail joints; take a fairly intuitive approach to cutting joints that minimizes the need for detailed planning; minimize the need to purchase special bushings or bits.

It is still another objective of the present invention to provide these capabilities in a rugged device which is not costly to manufacture and can therefore be made more affordable than jigs in the market having some of the same capabilities. It was in fact the cost of such jigs that motivated this inventor, when needing to make his first dovetail joint, to embark on a series of experiments which lead to the present invention.

DESCRIPTION OF INVENTION

Figure 1:
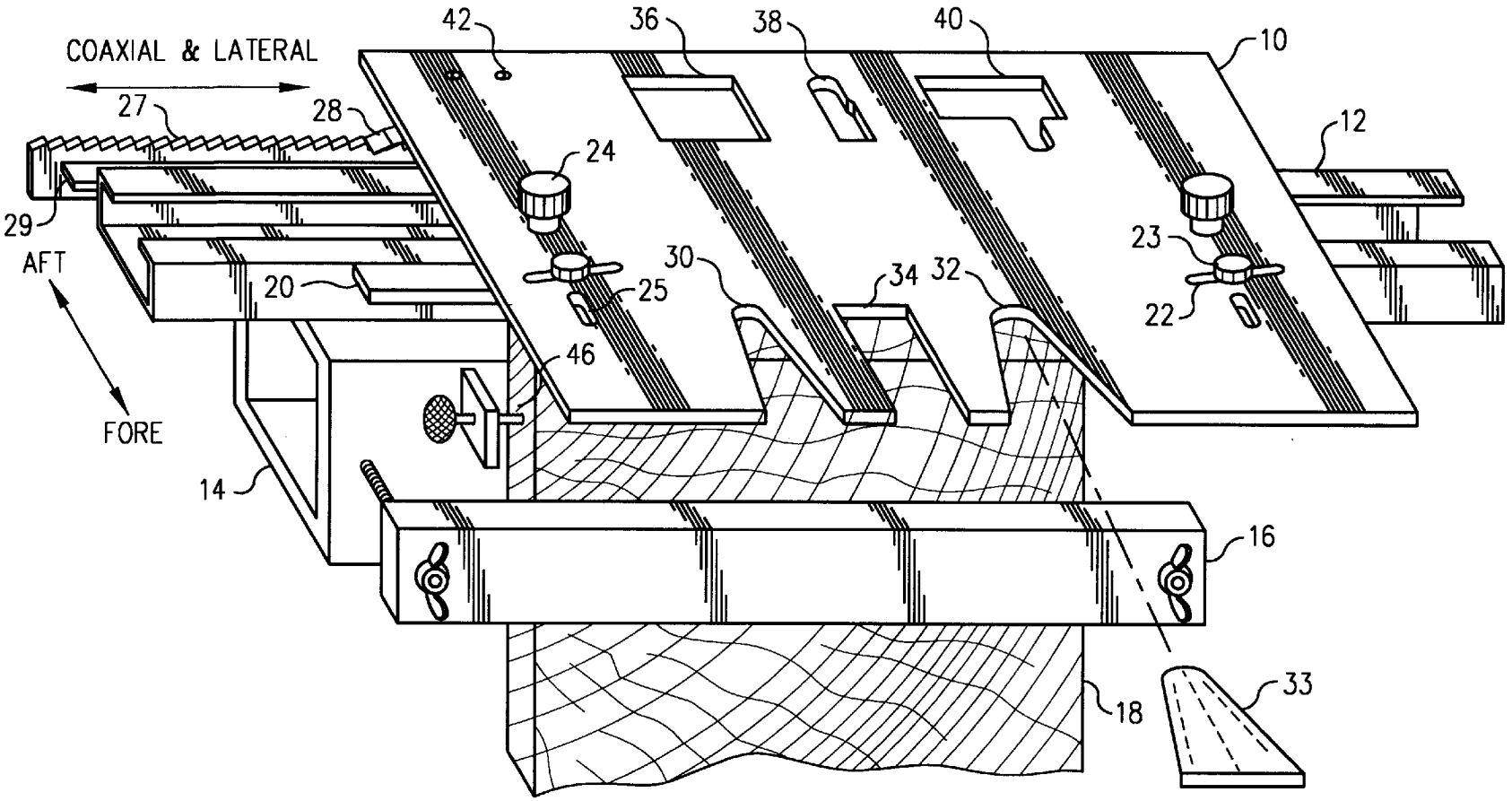
FIG. 1 is a perspective view of the jig as set up for cutting through dovetails and their corresponding pins. It shows most of the principle components.

A typical embodiment of the present invention is illustrated in FIG. 1. A board or workpiece 18 is held flat against a support base 14 and normal to a template 10 by means of a clamping bar 16. The support base may be a stock square or rectangular channel as shown, a channel formed of sheet metal, or even a wooden block. The support base is typically clamped or bolted to the workbench. Left/right or lateral position of the workpiece is determined by an adjustable side stop such as a screw 46. The end of the board bears flat against the underside of the template 10. The template is made from metal or a suitably rigid and stable material roughly one quarter inch thick. Some but not all of its features must be dimensionally accurate within a few thousandths. Fabrication on a milling machine is contemplated.

A router sits atop the template with its cutting bit 11 protruding through one slots or cutouts 30, 32, 34, 36, 38, 40. The router is fitted with a bushing, or the shank of its cutter bit with a ball bearing, that slides or rolls along the sides of these slots or cutouts, and in this manner guides the Touter.

Figure 2:
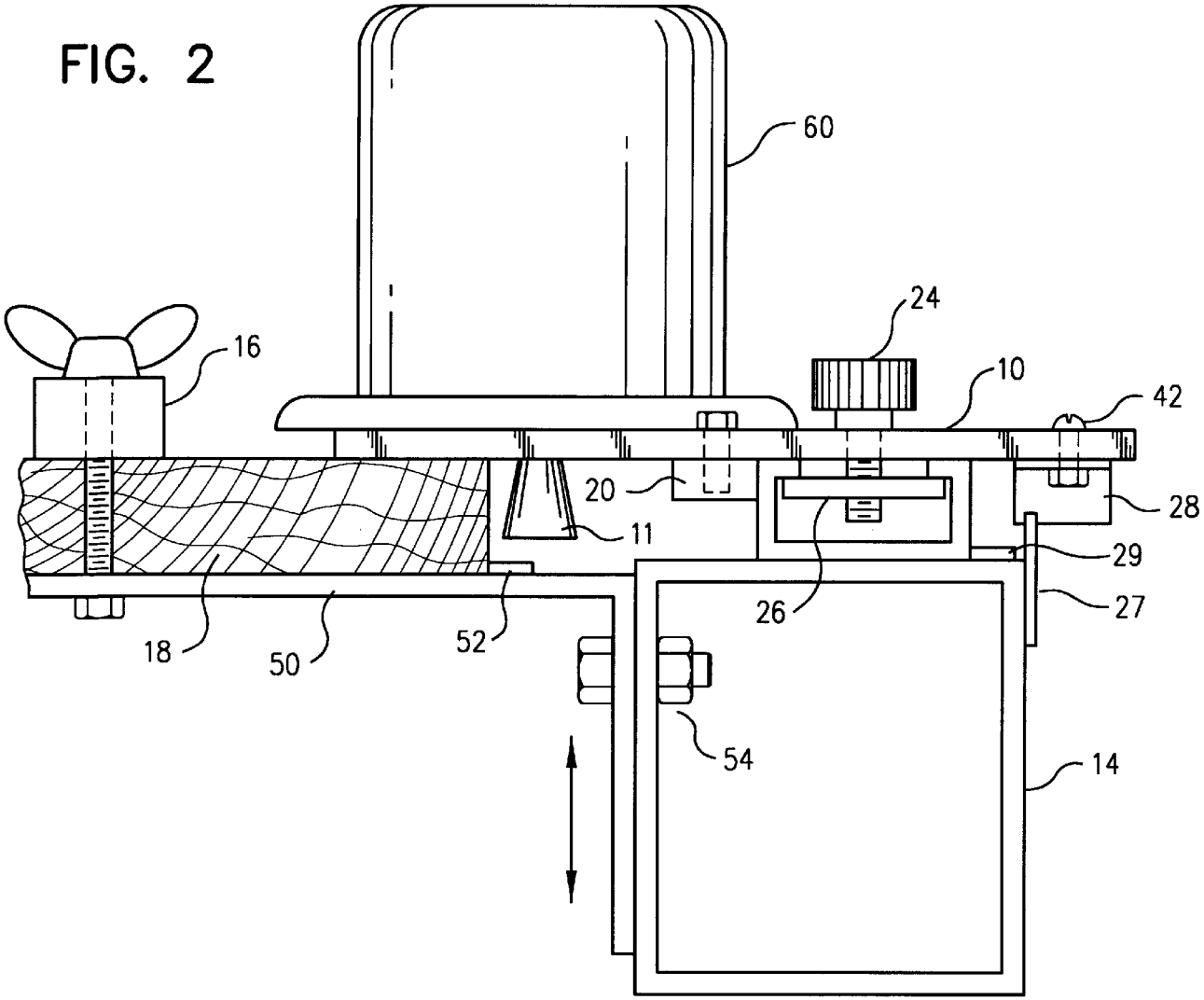
FIG. 2 is a left hand end view showing how a workpiece, such as a drawer front, is positioned for cutting half blind dovetail sockets.

The template 10 sits flush atop an open channel 12 which captures a square clamping nut 26 (best seen in FIG. 2). The template is locked down against the channel 12 as needed by twin clamping knobs 24 which penetrate the template through elongated clamping slots 25 into the treaded clamping nuts 26. Two pairs of clamping slots are provided since the template is reversed when using the rear cutouts to make half blind dovetails or when using the unbroken rear side of the template to guide the router in making sliding dovetail joints. The upper surface of the support channel 12 is normal to the front face of the support base 14. The channel can be made inexpensively using stock aluminum extrusions or formed metal channels.

Figure 3:
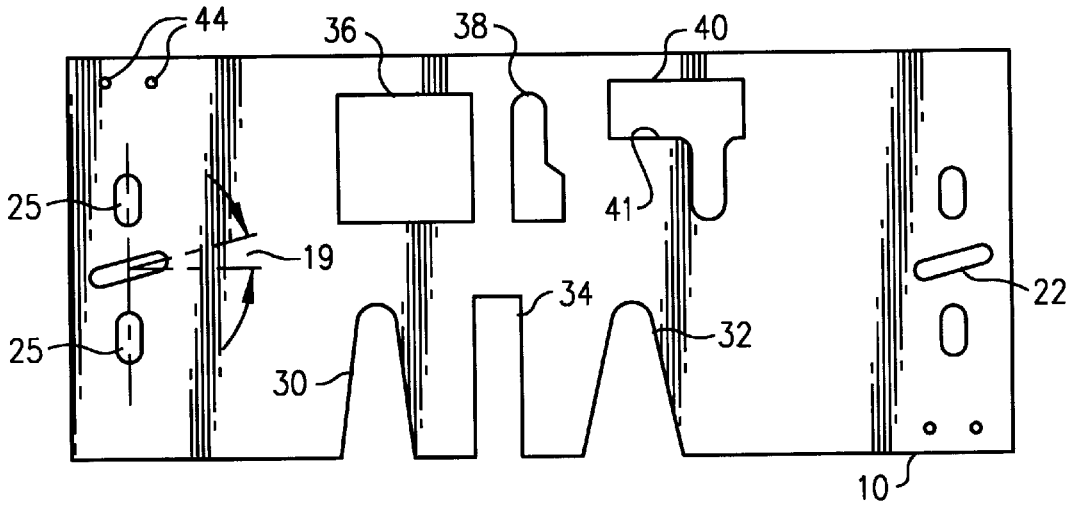
FIG. 3 is a top view of the template showing the shape and position of the various slots and cutouts whose edges are used to guide the router.

Provisions for Fore/Aft positioning—A single metal adjusting bar 20 extends across the underside of the template. Its purpose is to facilitate making fine adjustments in the fore/aft position of the template relative the workpiece which in turn controls tightness of fit between dovetails and their respective pins. The adjusting bar is secured to the template by two bolts 23 which extend through adjusting slots 22 to threaded holes in the bar. As best shown in FIG. 3 The adjusting slots are angled identically relative to the axis of the template. The angle 19, in the 10 to 20 degree range, is chosen so a relatively coarse left or right movement of the bar will cause it to move forward or aft a fine distance while remaining exactly parallel to the axis of the template. To ensure parallel movement the bolts must fit their slots with minimal play.

Figure 4:
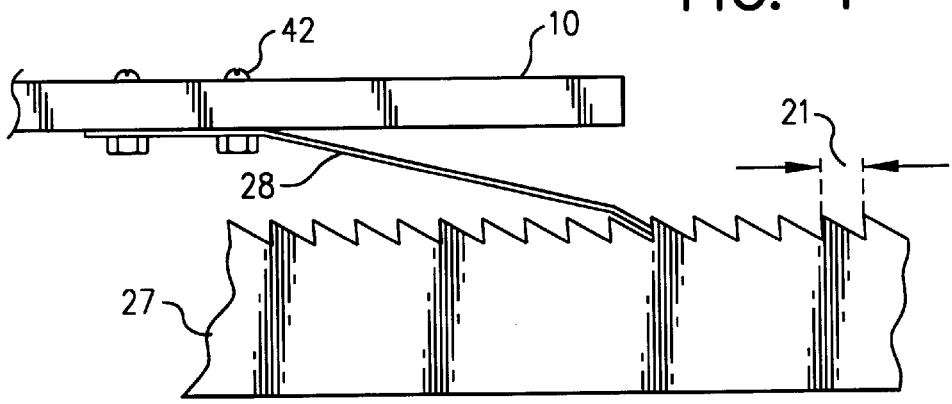
FIG. 4 is an exploded view of the ratchet spring and saw tooth rack used for indexing.

Provisions for Indexing—FIG. 4 provides an expanded view of the ratchet spring 28 and associated saw tooth rack 27. The ratchet spring is attached to the template by a bolt 42 which descends through holes 44, or by equivalent means. The template is indexed in the lateral direction by seating a spring ratchet 28 in the gullets of a saw tooth rack 27 which extends the length of the jig. The teeth are machined or otherwise rendered so they are spaced a precise and equal distance apart, said distance being called "pitch." The meaning of the term "pitch" is made clear in FIG. 4 by assigning it the number 21. For a variety of reasons, to be explained later, a tooth spacing or pitch 21 of one eight inch is a very important aspect of this invention. The spring ratchet 28 is permanently bent so it presses down upon the rack 27. As shown in FIG. 4, the spring ratchet is several times longer than the distance between the bottom of the template and the saw tooth rack so the spring ratchet will assume a small acute angle relative to the rack.

The exact shape of the teeth is not important; however three things are important. First, they must have a near vertical face on one side and a ramp on the other so the ratchet will seat when pushed in one direction and skip when pushed in the other. Second, it is necessary that the acute angle at their root be sufficiently sharp to seat the end of the spring ratchet into one unambiguous position every time the template is moved against the teeth. In practice moving the template left will probably seat the ratchet, while moving it right will skip the ratchet to the next cutting position. The tops of the teeth will probably be rounded for safety and minimum wear. The end of the spring ratchet which engages the teeth must be wide enough so it will engage over the full fore/aft adjustment range of the template, and it must be normal to the longitudinal axis of the jig so the lateral position of the template is not effected by any fore/aft adjustment. The third important aspect of the teeth is the pitch 21 which has a preferred value of $\frac{1}{8}^{th}$ inch. The rationale for this is described in detail later.

A long marker strip of wood, cardboard or plastic 29 can be positioned alongside the saw tooth rack and marked to show where the end of the ratchet should be positioned for various cuts. Such strips can either be marked up by the craftsman as he proceeds or preprinted by the jig supplier to a variety of joint designs. This strip is a convenience not a necessity.

Another convenient but not essential accessory to this invention are "slot gages", one of which appears as number 33 in FIG. 1. Slot gages might be made of transparent plastic and have printed or inscribed upon them the centerline of the slot and/or the cut line that a given cutter/bushing combination will make relative to the side of the slot. When placed in a pin or tail slot such a gage could be used to align the template with marks on the workpiece if the craftsman does not entirely trust what he judges by eye to be the correct position.

Half Blind Dovetail Accessory—FIG. 2 is an end view with two main purposes. First it helps clarify the relative positions of a router 60, template 10, support beam 14, support channel 12, alignment bar 20, saw tooth rack 27, clamp down knob 24, and square nut 26 threaded to receive the camp down knob. Second, it shows an important accessory, a support shelf 50, in position for making blind dovetail cuts on a drawer front. The support shelf is clamped to the support channel via bolts 54 which extend through elongated holes (not shown) in the support shelf so the shelf can be adjusted up or down so a workpiece 18 of any thickness can be moved into contact with the underside of the template. The clamp bar 16 is detached from the support base 14 and attached to the support shelf 50 where it holds the workpiece. The fore/aft position of the workpiece is determined by an adjustable stop 52 which may be as simple as a bolt descending through an elongated hole or slot in the support shelf to a nut below.

Details of Slots and Cutouts—FIG. 3 shows the approximate shape and location of the various slots and cutouts in the template. In general the bottoms of slots 30, 32 and 34 are positioned to stop the router after it has cut entirely through the workpiece but before the bit touches any part of the jig itself. The template must extend forward toward the user far enough to support the router before and after making a cut through the thickest intended workpiece.

Certain sides of these slots and cutouts are guiding surfaces for the router bushing and must be dimensionally precise and durable. Important aspects of slot shapes are as follows. The rectangular tail slot 34 has straight, parallel sides exactly normal to the longitudinal axis of the jig and thus the face of the workpiece. The purpose of slot 34 is to guide the router in cutting through dovetail slots using a dovetail bit, or for making box joint cuts with a straight bit. Slot 34 is just wide enough to produce a sliding fit with the intended router bushing, thus ensuring the cutter bit will make a straight cut back through the workpiece. The shape of the bottom of slot 34 is not important and the rounded corners play no functional role.

The two "V" shaped pin slots 30 and 32 are used to guide straight bits in the cutting of pins for through dovetail joints. This invention contemplates from one to perhaps five or six different V slots on a single template depending on the number of bit angles one wants to support. However, there is little practical reason to make the template longer and more costly just to support angles that are so close to each other they make no visual difference. In practice two pin slots are probably sufficient, as the drawings indicate.

Current intent is to configure one slot to cut the pins associated with 8 degree tails, while the other supports 14 degree tails.

As shown in FIG. 3, the "V" slots open forward toward the user and converge toward the rear. Their sides are straight. The angle between them is the same as the angle made by the dovetail bit used to cut the corresponding tails. For example a pin slot whose sides are angled 8 degrees relative to the slots centerline would be used in conjunction with what the industry calls an 8 degree dovetail bit.

The pin slots are shaped so that the centerline of the cutting bit will follow a precise V shaped path in the workpiece thus cutting the opposing faces on two pins. The jig is dimensioned and adjusted so that the centerline of the bit is at the apex of the V just as it exits the rear of the workpiece, assuming the preferred size of router bushing is used.

A beneficial refinement of the slot geometry (too small to show on the drawings) is to extend the slot so the centerline of the bit can proceed straight inward a fraction of an inch beyond the apex of the V. This causes the centerline of the bit to take a "Y" shaped path so the center line of the bit will travel slightly beyond the workpiece. This helps clear chips and creates a small useful thump signaling that the cut is complete. This refinement means the angled sides of the pin slots transition into a very short section, where they are parallel, then transition again into whatever shape will be used for the bottom of the slot (most likely a rounded bottom which conforms to the preferred bushing).

There is a preferred size bushing for the tail slot (which equals its width) and a preferred size for the V slots and cutouts. Operation is less complex with the preferred size; however, for economy or to achieve additional design flexibility other size bushings can be used.

The distances between the centerlines of the tail slot 34 and the centerlines of the pin slots 30 and 32 are important for ease of use reasons. They should be an integer multiple of the tooth pitch 21 on the saw tooth rack 27.

It will not be illustrated or emphasized but this invention could easily support still other joint designs, such as the interlocking "loops" described by Grisley in U.S. Pat. No. 5,114,265, simply by adding other appropriately shaped slots or cutouts to the template. The only requirement being that spacing between repetitive elements of such joints must be a multiple of the pitch on the saw tooth rack.

The cutouts 36, 38 and 40 are used to shape half blind dovetail joints which are commonly used to attach the sides of a drawer to the front. (The template is reversed fore to aft for this purpose.) Such joints have no pins, rather tails are cut in both members of the joint. FIG. 5 shows the path the bushing takes in each cutout and the result to the workpiece. The template is repositioned for each of the numerous cuts needed to make a complete joint. Details on the design of the cutouts follow.

Figure 5A:
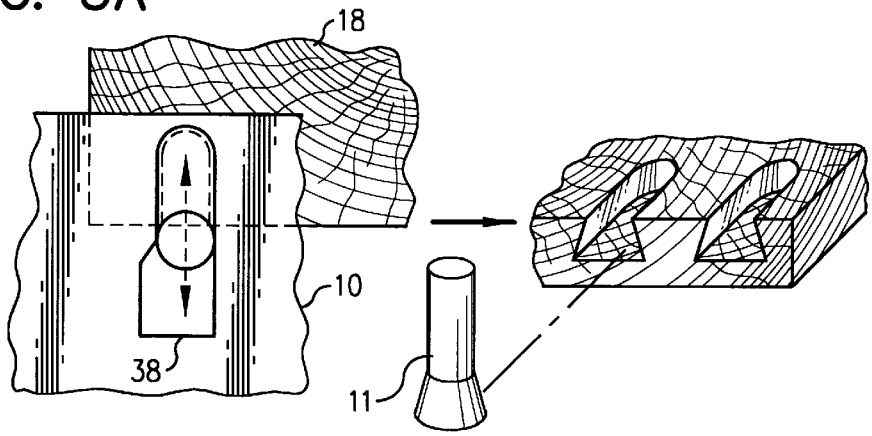
FIGS. 5A, 5B and 5C show the path taken by the cutter relative to the template cutout while making half blind dovetail joints, and the results to the workpiece.

FIG. 5A shows how cutout 38 causes the dovetail bit 11 to make a straight fore/aft cut. The enlarged end of cutout 38 simply provides added room to enter and remove the bit. This cutout is typically used to make blind dovetail sockets in a drawer front, as the figure illustrates.

Figure 5B:
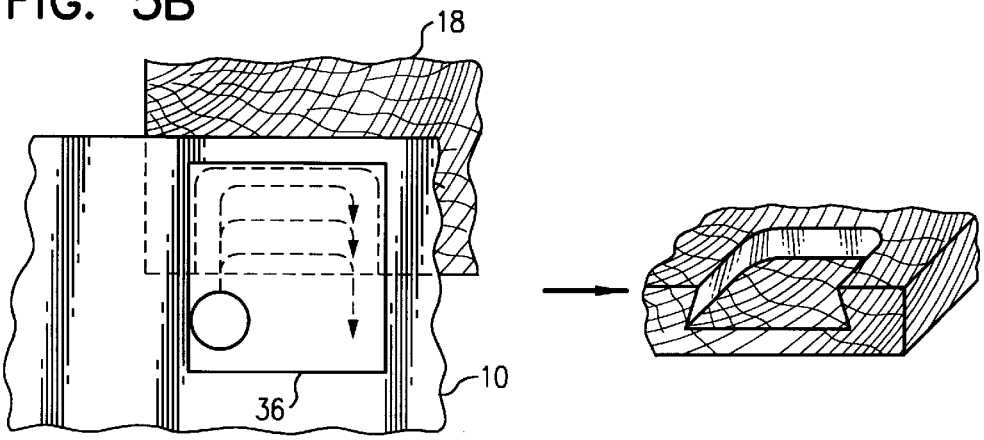

The waste cutout, number 36 in FIG. 5B, is rectangular and is used to remove waste between two narrow sockets in order to make one wide socket. Its sides are displaced from the sides of cutout 38 by an integer multiple of the pitch. It's outer-most face is the same distance from the edge of the template as the outer extremity of cutout 38.

Figure 5C:
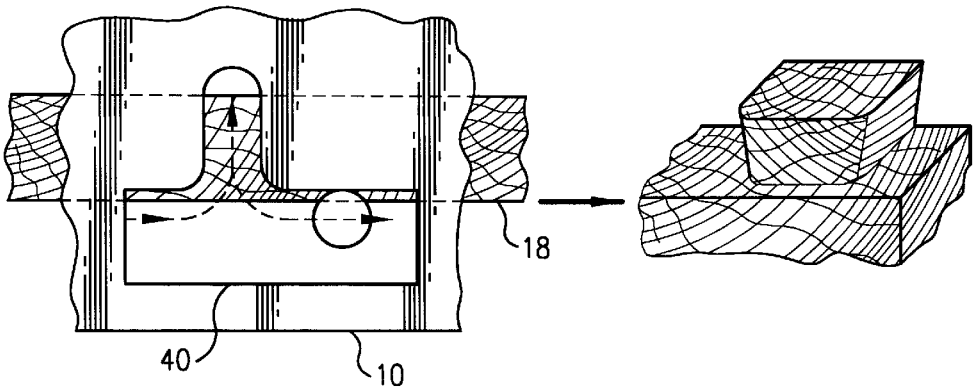

Cutout 40 is for making tails, typically in the side members of a drawer. As shown in FIG. 5C, the narrow slot in this cutout causes the bit to move straight back through the workpiece thus cutting the sides of the tails. The ledge 41 to one side of that slot (see FIG. 3) allows the bit to cut an inclined face across the face of a wide tail, up to a limit determined by the width of this cutout. If a wider tail is needed the jig can be repositioned. The curved entrances to the narrow slot in cutout 40 cause the edges of the pins to be rounded so they will fit snugly within their respective sockets. The remainder of this cutout must provide room to enter and remove the bit but its shape is not important.

Figure 6A:
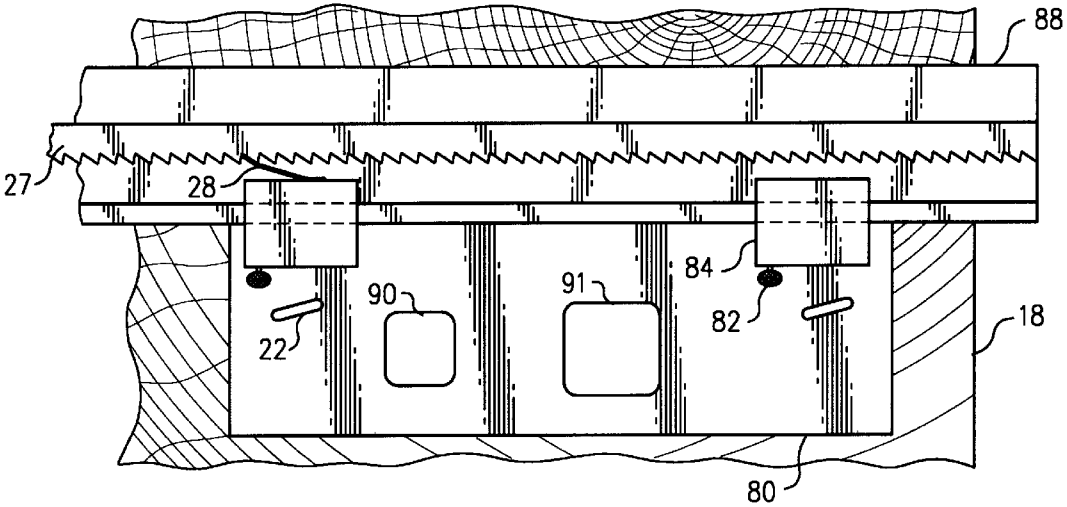
FIGS. 6A and 6B show an embodiment of the invention that could cut mortises across a wide plank or panel.
Figure 6B:
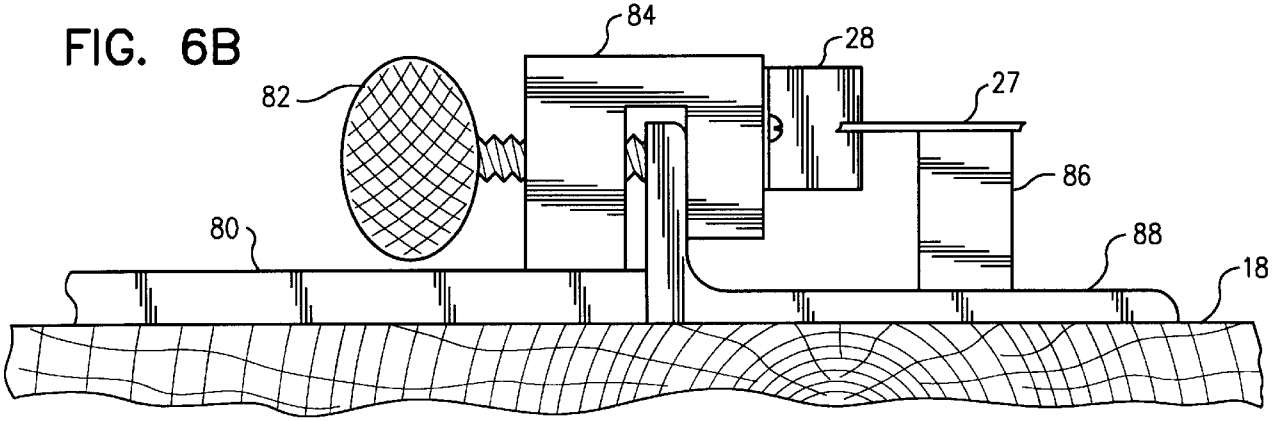

Embodiment for cutting mortise and tenon joints—FIG. 6 is an embodiment that could cut a string of mortises across the face of a wide plank. As a consequence of the round cutter bit used, both the mortises and their corresponding tenons will have rounded comers. Template 80 has the same holes and slots for attaching the spring ratchet, adjusting bar and clamping knobs as does template 10, but it has different cutouts. Cutouts are provided for both the mortise 91 and the tenon 90 cuts. The dimensions of these cutouts must bear certain specific relations to the size of the bits and bushings to achieve a perfectly fitting joint. There could be several pairs of cutouts in support of various sizes of mortises and tenons; however, only one pair is shown. To cut mortises a wholly different base structure would be used. As shown in FIG. 6A and 6B, a long angle bar 88 extends across the workpiece and provides a rigid straight line reference for the template 80. A clamp 84 (removably attached to the template) and clamp screw 82 hold the template to the angle bar while cutting. The spring ratchet 28 and saw tooth rack 27 are as before. The rack is attached to the angle bar by a rack support 86.

The tenons in the end of a corresponding workpiece are cut with the same setup illustrated in FIG. 1, except that template 80 would be used rather than template 10.

Detailed rational for a particular pitch on the saw tooth rack—A very important element of this invention and claim for its uniqueness is the specific tooth spacing or pitch (number 21 in FIG. 4) chosen for the saw tooth rack. Only one specific value, namely one eighth of an inch satisfies all the criteria in the US market today or any other market using cutter bits dimensioned in multiples or sub multiples of an eighth of an inch. In markets using metric bits the same logic would apply, however the value would be specified in millimeters and would fall in the range of 3 to 6 millimeters.

The pitch value chosen is a function of the following five considerations: 1) granularity of choice in the aesthetics of the joint, 2) compatibility with standard cutter bit sizes, 3) ability to reposition the template "by eyeball", 4) manufacturing cost, and 5) durability. The detailed rationale follows.

First the pitch must work with popular cutter bit sizes. For example, when constructing basic box joints each slot is exactly the width of the bit used and the spacing between slots is exactly twice the cutter diameter. Since most straight cutter diameters come in 1/16 inch increments it follows that spacing between cuts must be some multiple of 1/8th inch depending on size of the cutter used. For example 1/4th inch cutters require a half inch spacing between cuts (as measured on centers) while a 7/16 diameter cutter will require 7/8th inch spacing. In addition, blind dovetails are frequently cut with 1/2 inch diameter bits and 7/8 inch spacing between cuts, again a multiple of 1/8th inch. The need for 7/8 inch spacing between the most common type of half dovetail cuts is, in a by itself, sufficient to rule out indexing in increments of 1/4th inch or 1/2 inch. Still another consideration (which relates common bit sizes to the desired tooth pitch) is that through dovetail joints require certain relations between common bit sizes and the space between dovetail cuts and corresponding pin cuts. If the rack pitch is 1/8th inch then any pair of bits (the dovetail bit and the straight bit that will be used in making a given joint) whose radii add to some multiple of 1/8th inch (which many do) work very nicely together because the center lines of their cuts should always be an integer multiple of exactly 1/8th inch apart to produce a good joint, and the 1/8th inch pitch of the rack ensures they always will be.

Clearly a tooth pitch in millimeters or of some arbitrary size would not allow the operator to move the template in multiples of 1/8th inch as required. Also we have shown that pitches which are multiples of 1/8th such as 1/4th or 1/2 inch are not suitable. However 1/8th inch and fractions thereof such as 1/64th, 1/32th, or 1/16th inch do meet this first requirement.

Second the pitch should allow the pins and tails to be sized with enough granularity or variation to achieve the desired aesthetic effect. Being able to produce joints with almost any pin or tail size is a key advantage of this jig, but the issue here is the size of the increments by which they can be varied. One popular jig allows infinite variability but that seems unnecessary because varying the width of a pin or tail in increments of less than 1/16th inch would not be noticeable to the eye. Even 1/16th would be hardly noticeable. On the other hand increments of 3/16th or greater are not fine enough to give the craftsman the look he or she desires. In sum, increments of 1/8th inch seem ideal in meeting this criteria.

Third the pitch should be large enough so the craftsman can judge by eyeball when the template is properly positioned for a given cut. In operation the main challenge is to index the V or pin slots to the correct position when making the first pin piece. This of course applies to a project where no preprinted marking strip is available, as will often be the case with creative craftsman. The process in these situations is to trace the outline of the tails from the tail piece directly onto the end of the pin piece and then position the V slot relative to that tracing. However since the side of the V slot is offset by about 1/4th inch from where the bit will actually cut and since the tracing itself is off a bit due to the thickness of the pencil it is only practical to judge "by eyeball" the proper position of the template relative the workpiece with a certain degree of accuracy. If the pitch is 1/16th inch or less it is essentially impossible to judge by eye whether the ratchet is seated in the correct notch. However is fairly easy to do so if the pitch is 1/8th inch or greater. Certainly a slot gage 33 can help reduce the uncertainty by showing exactly where the cut line will be relative to the side of the slot, but the inaccuracy of the tracing still makes a pitch of 1/16th or less impractical. In addition, it is not convenient to use a slot gage every time the template is repositioned.

Having a reasonably large pitch is also important when using pre-printed marking strips where cutting positions are determined by aligning the end of the ratchet spring with marks on the strip. Due to parallax, and the width of the marks on the strip it would be hard to work with increments of 1/16th inch, and anything smaller than 1/16th would be totally impractical. In sum, pitches of 1/8th inch or greater meet the requirement of being able to index the jig by eyeball. One 1/16th is questionable in this respect. Anything less than 1/16th is totally unsuitable.

Forth the pitch should be large enough to minimize manufacturing costs. Larger teeth require less precision on the face of both the teeth and the ratchet. The fewer the teeth the less it costs to machine them. This favors 1/8th over 1/16th all else being equal.

Fifth the pitch should be large enough that the teeth will not wear down or be rounded over through use. Certainly teeth smaller than 1/16th inch are judged unable to meet this requirement.

Conclusion. A tooth pitch of 1/8th inch is uniquely optimum for this invention in the US market, although 1/16th might be marginally acceptable. The same logic could be used to derive the optimum pitch for markets using metric bits and would probably result in a choice in the range of 3 to 6 millimeters.

Operation of Invention

In general the spaces between individual dovetails or pins are cut one at a time by guiding a router along the sides of slots or cutouts in a template 10. The template is repositioned laterally, relative to the workpiece 18, as needed to create a series of dovetails or pins having the desired width and spacing. The position of the template in this lateral movement is accurately indexed by a ratchet 28 which engages a saw tooth rack 29 having a preferred pitch of one eighth inch between successive teeth.

The end of the ratchet is always seated firmly against a tooth before the template is clamped down for cutting. This indexing scheme causes the template to repositioned some exact integer multiple of the tooth pitch from a prior position, but not at some indeterminate intermediate point.

An infinite variation in tail width or spacing is not the intent of this invention. Rather all cuts are spaced in multiples of the tooth pitch, which is sufficiently fine to give all the variability the eye can appreciate. The great benefit in moving in discrete steps of a reasonable size is that the template can be moved from one cutting position to the next without using precision scales to make "analog" adjustments. Instead the craftsman need only move the template to whichever notch which looks about right. The ratchet then seats against the tooth to provide an exact and repeatable position accurate within a few thousandths of an inch (typically two thousandths or less). As explained previously, the size of this increment of movement is a key aspect of the present invention as it represents a unique compromise among a variety of factors.

Repositioning the template—The template is repositioned by first loosening the clamping knobs 24 which lock it tight against the support channel 12, then manually sliding it to approximately the correct cutting position as judged either by aligning the end of the spring ratchet 28 with a mark on the marker strip 29 or by visually aligning the cutting slot with marks on the workpiece. At this point the user presses the template backwards and laterally against the direction of the teeth. This single diagonal pressure causes the adjustment bar 20 to bear evenly and firmly against the support channel 12 and the ratchet 28 to seat in the gullet between two teeth on the saw tooth rack 27 thus positioning the template with great precision. At this time the template is locked down for the next cut. If the template is moved with the teeth the spring ratchet will simply skip from tooth to tooth. The spring ratchet is lifted manually to clear the teeth when movement in the opposite direction is desired.

Adjusting joint fit—If a trial through dovetail joint is too loose or too tight, the fit of subsequent joints can be adjusted using the adjusting bar 20. The tightness of a through dovetail joint can be controlled by moving the template a very small amount fore or aft which widens or narrows that part of the V or pin slot 30 or 32 which lies above the workpiece. This in turn alters the width of the space routed out between opposing pins. This process is accomplished by loosening the adjustment bar 20 and pushing it to the left or right. Since the adjusting bar is affixed to the template by bolts 23 passing through inclined slots 22 that lateral movement also moves the bar forward or aft relative the template, and since the adjusting bar bears against the support channel adjusting it causes the template to move forward or aft relative the workpiece when all parts are seated for a cut. Once set this adjustment seldom needs changing, even if different thickness boards are used.

Cutting tails for through dovetail joints—The workpiece 18 is clamped flush against the support base 14 and template 10 as shown in FIG. 1. The lateral position of the workpiece is adjusted with the side stop 46, (usually so the centerline of the workpiece is aligned with the centerline of the tail slot with the template seated in any notch). The router is fitted with a bushing the same nominal diameter as the width of the tail slot 34, and with a dovetail bit. For the first joint the template is positioned either by aligning the end of the spring ratchet 28 against preprinted marks on a previously designed marking strip 29, or simply by observing where the cut will be relative to the workpiece if this is a design as you go joint. The router is placed flat on the template with its bushing in the tail slot and pushed backward until the bit has cut a dovetail shaped slot through the workpiece. If a blank marking strip is being marked up for the first time the position of the template is noted on it with a pen or pencil mark at the end of the spring ratchet 28. Tail slots wider than made by a single pass of the cutter are created by repositioning the template a notch (or several) further along as needed. After cutting one tail slot the template is repositioned for subsequent tails. Identical sets of tails on the other end of this board or on other boards are cut by referencing this same marking strip.

Note that a wide variety of bit sizes can be used. With this jig.

Cutting pins for through dovetail joints—The process is essentially the same as for cutting tails except a straight bit is used in conjunction with one of the "V" or pin slots 30 or 32. The bushing is slid along the angled sides of the slot and all the way to the back, then moved about to waste any wood in between. Again wider slots are made by repositioning the template to widen the slot.

If using a pre-marked marker strip provided with the jig, all cutting positions are found simply by moving the template so the end of the ratchet spring lines up with a mark on the marker strip. However if the craftsman has designed his own unique joint a different process is needed to locate the pin cuts so they will match the previously constructed tails. For the first workpiece the proper position of the template can be judged by eye by aligning the V slot with a tracing of the tails made onto the end of the pin board by pencil or pen. As noted, a slot gage 33 can be used to assist if necessary. It is only necessary to eyeball this alignment well enough so the ratchet seats against the correct tooth. Actual contact between the ratchet and tooth brings the template into exact position. This rather simple process that avoids using any precision scales is a key benefit of the present invention. As the craftsman proceeds from cut to cut he or she marks up a blank strip that will be reused for the rest of the project.

Cutting box joints—A straight bit is used in conjunction with tail slot 34.

Cutting joints with mixed dovetail and box elements—First dovetail shaped slots are cut using a dovetail bit in the tail slot 34. Then box elements are added using a straight bit in the tail slot. Thus a tail can have one tapered side and one straight side, or a wide tail can have one or box elements between its tapered sides. This type joint is visually quite distinctive, and a unique advantage of the present invention.

Cutting Half Blind dovetails on drawer sides—FIG. 5C shows the details of this process. Preparation requires reversing the template10 so the cutouts 36, 38 and 40 are over the end of the workpiece, which is clamped vertically as shown in FIG. 1. This reversal is accomplished by removing the template from the body of the jig then removing and reinstalling the adjusting bar 20 using the other set of adjustment slots 22. The spring ratchet 28 is also moved to the other side of the template. A dovetail bit is used in conjunction with a bushing the same nominal size as the width of the slot in cutout 40.

To make a cut the bit is lowered through the back of the cutout 40 outboard of the workpiece. Then the router is turned on and guided down the slot, along the rounded comers at the entrance of the slot and along the ledge 41 adjacent the side of the slot. The ledge extends well clear of the slot to allow facing a rather wide tail. The path taken by the bit is indicated in FIG. 5C, as is the result to the workpiece. If cuts wider than a single pass of the bit will produce are needed the template can be repositioned one or more notches to the side. Alternately two slots can be cut and the wood between them wasted by moving the waste cutout 36 into position and sweeping the bit about as needed. The indexing process is as described earlier.

Cutting Half Blind dovetails on drawer fronts—In preparation the workpiece is placed horizontally using an auxiliary support shelf 50 as shown in FIG. 2. The shelf is adjusted vertically by loosing the shelf bolts 54 then moving the workpiece up until it contacts the underside of the template. The depth of the sockets in from the end of the board is set with an adjustable stop 52, which governs the fore aft position of the workpiece in the jig, and by the placement of the adjusting bar 20. The same bushing and dovetail bit are used that were used for the drawer sides. (The tightness of half blind dovetail joints is adjusted by changing the depth of cut on the router, not adjusting the jig.)

The cut is made by moving the bit straight back through slot 38 as shown in FIG. 5A. Again the jig is repositioned to make wider sockets if desired, and between the cutting of successive sockets. As shown in FIG. 5B, the waste cutout 36 can also be used to waste the wood between sockets in order to make a wider socket.

Cutting sliding dovetail joint—Cutting the long dovetail shaped socket for a sliding dovetail joint does not require a jig, just a straightedge clamped to the workpiece. However, this jig is designed to cut the matching "tail" on the end of the workpiece (often a shelf). To do this the straight and unbroken rear edge of the template is brought forward by reversing the template as described above. The workpiece is held vertically as in FIG. 1 and the fore aft position of the template is adjusted until sliding the bushing along the now front edge of the template will cut one face of the tail across the entire end of the workpiece. The opposite face of this long "tail" can be cut by reversing the workpiece. The width of this "tail" and thus its fit is controlled using the adjusting bar.

Cutting a row of square mortises and tenons—A different template with different shaped cutouts is needed for this job. The mortises can be cut with the embodiment shown in FIG. 6. A plunge router would work best. The mortise cutout 91 in template 80 is designed to cut the mortises or sockets, which of necessity have round corners of no less radius than that of the cutter bit. The other cutout 90 will be shaped and sized to cut a matching tenon. A row of mortises is cut across a wide plank simply by clamping the angle bar 88 to the workpiece and moving the template from one position to another using the same indexing scheme as described previously. The clamp screws 82 secure the template for each cut. The tenons would be cut by moving this reinstalling this template on the support structure described previously and using cutout 90. The workpiece would be held vertically as in FIG. 1. The fore/aft position of the template could be adjusted to place the tenons where desired in that dimension. Tenons would be cut one at a time by repositioning the template laterally.

Conclusion, Ramifications, and Scope of Invention

The reader will see that the invention provides a simple, highly precise way for the craftsman to create a variety of woodworking joints whose dimensions can be varied to suite design and aesthetic goals. In addition, the invention reconciles the seemly contradictory objectives of extreme accuracy with the convenience of being able to reposition the template from one cutting position to the next by "eye ball". Cuts can be placed within a few thousandths of intended position without reference to eye straining precision scales. Cuts and entire joints are repeatable even if the jig has been readjusted to make other joint designs in the interim. Through dovetail, blind dovetail, sliding dovetail and box joints using two or more dovetail angles and the full range of commercially available router bit sizes can be made with one relatively inexpensive template. In addition the invention is rugged and is relatively inexpensive to manufacture because the template and the saw tooth rack are the only parts that will probably be machined. Other parts are either stock shapes or bent from sheet metal. No other jig known to the inventor has this range of versatility and advantages.

Other embodiments are possible, although only one for cutting a row of mortises and tenons has been described herein. For instance the indexing means described herein could be used to construct a general purpose lateral positioning device. Likewise, and as briefly noted, the template can have slots or cutouts for other joint designs beside dovetail and box. The use of this invention for such joints is contemplated.

Variations in design detail are also contemplated. For example the spring ratchet could be a rigid hinged ratchet with or without spring assist to press it down. Alternately the teeth could be engaged by the face of a member rigidly attached to and descending from the template. There are many variations on the detailed shape of the teeth and ratchet face. Specifically the ratchet can either wedge itself between two teeth so it exerts equal pressure on the faces of both, or it can press principally against one face of one tooth. If it wedges between two teeth the end of the ratchet and the shape of the teeth can be of various shapes requiring only that when fully engaged one can not move laterally relative the other. With a saw tooth rack the teeth also have some variation. For example the approximately vertical face can form a sharp acute angel with the sloping face thus providing a sharp gullet into which the face of the ratchet can be wedged, or the gullet can be rounded with a correspondingly rounded ratchet face. Again with a saw tooth rack the important point is that the lateral position of the template relative the rack have only one unique position when the ratchet is pressed against the tooth. The support channel might be integral with the support base as a single extrusion. The adjusting bar could be captured in a slot integral to such an extrusion. The entire fore alt adjusting mechanism could be accomplished in various ways, although a single bar attached via angled slots has definite advantages. The cutouts and slots could have alternate arrangements from that illustrated and could be implemented on different templates even though economy suggests combining them on one in so far as practical.

In sum this jig is expected to succeed in the market because it can match any jig in the variety of joint designs it can support while also being easier to operate and/or less costly to manufacture.

What is claimed is:

1. A jig for making a joint in a workpiece, comprising:

a first support structure to support the workpiece and a template in proper position relative to each other, the first support structure having a lateral axis parallel to the direction a template will be repositioned between cuts parallel to the end of a workpiece, and parallel to an elongated toothed rack;

a template incorporating at least one guiding surface to guide a router in the cutting of joints, the template being repositionable a number of times along the lateral axis to make a plurality of cuts defining a row of joint elements across the end of the workpiece;

a keeping member to keep said template from moving relative to the workpiece; repositioning members to reposition said template from one cutting position to another in a direction parallel to the row of joint elements;

an elongated toothed rack coaxial with and fixed to said first support structure, the toothed rack having a plurality of equally spaced teeth having a pitch and being indexing points to establish the proper lateral position of said template relative to the workpiece;

an indexing member having two ends, one end being attached to the template and the other end being seated relative to a tooth of said rack to accurately index the lateral position of said template relative to the workpiece in one of a plurality of acceptable cutting positions, the acceptable cutting positions being separated by distances that are exact integral multiples of the tooth pitch; and an adjusting member to adjust the transverse position of guiding surfaces of said template relative to the workpiece in order to slightly alter the joint, whereby tightness of the joint is optimized.

2. The jig of claim 1, each of said teeth being shaped substantially like a saw tooth having on one side a face at least some portion of which is essentially normal to the lateral axis of the rack and having on the other side a face that slopes from the root to the tip of said tooth, the indexing member being seated against the essentially normal face of one of said teeth and said template establishing its coaxial or lateral position principally from said essentially normal tooth face.

3. The jig of claim 1, wherein each tooth has an axial profile that is approximately symmetrical about a transverse plane and said indexing member is seated by wedging it between two teeth so that it establishes its position by pressing essentially equally against both teeth.

4. The jig of claim 1, wherein the tooth pitch is exactly $1/8^{th}$ inch.

5. The jig of claim 1, wherein said indexing member includes a flat piece of spring metal bent so as to exert a pressure on said rack.

6. The jig of claim 1, wherein the indexing member includes a member bearing against the toothed rack.

7. The jig of claim 1, wherein said template includes one or more of the following types of router guiding surfaces: "V" shaped slots or slots with angled sides whose centerlines are normal to the lateral axis of the jig and whose sides are angled to match dovetail bit angles; outside edges, slots or cutouts with sides normal or parallel to the lateral axis of the jig; slots or cutouts of irregular shape for cutting joint elements or parts of joint elements of curvilinear shape.

8. The jig of claim 1, wherein the template contains one or more "V" or angle sided router guiding slots and one or more parallel sided router guiding slots, each having centerlines, the centerlines of said slots being separated by an integer multiple of said tooth pitch.

9. The jig of claim 1, wherein said template is single integral piece of material into which said router guiding surfaces are formed.

10. The jig of claim 9, wherein said template includes one "V" shaped router guiding slot having angled edges and one router guiding slot having parallel sides.

11. The jig of claim 9, wherein said integral template incorporates two "V" shaped slots, at least one slot with parallel sides, several cutouts, and a straight edge parallel to the jig's lateral axis such that a multiplicity of different joints can be made using a single template.

12. The jig of claim 9, wherein said template includes for guiding surfaces two "V"-shaped router guiding slots of different angles and one or more router guiding slots having parallel sides such that said single integral template can be used to construct a joint whose elements taper at angle A, or a joint whose elements taper at angle B, or a joint where elements tapering at angle A and elements tapering at angle B are mixed in the same joint.

13. The jig of claim 9, wherein said template incorporates one or more "V" shaped slots, one or more parallel sided slots plus additional properly shaped cutouts for cutting half blind dovetail joints such that said single template has all the guiding surfaces needed to guide a router in cutting through dovetail and box joints as well as half blind dovetail joints.

14. The jig of claim 1, further including a second support structure, wherein said template incorporates a plurality of rectangular cutouts whose sides are guiding surfaces for cutting a row of tenons across the end of a workpiece when used with said first support structure and for cutting a plurality of mortises across the end of a workpiece when said template is used with the second support structure.

* * * * *